US005231655A

United States Patent [19]

Wei et al.

[11] Patent Number: 5,231,655

[45] Date of Patent: Jul. 27, 1993

[54] X-RAY COLLIMATOR

[75] Inventors: Ching-Yeu Wei; Robert F. Kwasnick; George E. Possin, all of Schenectady, N.Y.

[73] Assignee: General Electric Company, Schenectady, N.Y.

[21] Appl. No.: 802,789

[22] Filed: Dec. 6, 1991

[51] Int. Cl.[5] ..... G21K 1/02

[52] U.S. Cl. ..... 378/147; 378/149; 378/154

[58] Field of Search ..... 378/147, 145, 149, 4, 378/7, 19

[56] References Cited

U.S. PATENT DOCUMENTS 3,869,615 3/1975 Hoover et al. ..... 378/147

4,951,305 8/1990 Moore et al. ..... 378/147

*Primary Examiner*—David P. Porta

*Attorney, Agent, or Firm*—Donald S. Ingraham; Marvin Snyder

[57] ABSTRACT

A collimator for use in an imaging system with a radiation point source is formed from a plurality of collimator plates stacked together. Passages in each collimator plate in conjunction with the respective passages in adjoining plates form a plurality of channels through the collimator. The channel longitudinal axes are aligned with selected orientation angles that correspond to the direct beam path from the radiation source to the radiation detectors. The collimator plates are made up of patterned sheets of radiation absorbent material or alternatively comprise patterned photosensitive material substrates coated with a radiation absorbent material. The cross-sectional shape of each channel corresponds to the cross-sectional shape of the radiation detecting area of the detector element adjoining the channel. A method of forming a collimator includes the steps of selectively removing material from the collimator plates to form the passages therein, and stacking the patterned collimator plates together to align them so that the respective adjacent passages form a channel aligned with respective selected orientation angles corresponding to direct paths of radiation from the radiation source to the detector elements in the assembled array.

18 Claims, 5 Drawing Sheets

X-RAY COLLIMATOR

CROSS REFERENCE TO RELATED APPLICATIONS

This application is related to the application of R. F. Kwasnick and C. Y. Wei entitled "Radiation Imager Collimator," Ser. No. 07/802,797, filed concurrently with this application, and assigned to the assignee of the present application.

FIELD OF THE INVENTION

This invention relates generally to radiation imagers, and in particular to focused collimators used in conjunction with radiation detection equipment.

BACKGROUND OF THE INVENTION

Collimators are used in a wide variety of equipment in which it is desired to permit only beams of radiation emanating along a particular path to pass a selected point or plane. Collimators are frequently used in radiation imagers to ensure that only radiation beams passing along a direct path from the known radiation source strike the detector, thereby minimizing detection of beams of scattered or secondary radiation. Collimator design affects the field-of-view, spatial resolution, and sensitivity of the imaging system.

Particularly in radiation imagers used for medical diagnostic analyses or for non-destructive evaluation procedures, it is important that only radiation emanating from a known source and passing along a direct path from that source through the subject of examination be detected and processed by the imaging equipment. If the detector is struck by undesired radiation, i.e., radiation passing along non-direct paths to the detector, such as rays that have been scattered or generated in secondary reactions in the object under examination, performance of the imaging system is degraded. Performance is degraded by lessened spatial resolution and lessened energy resolution, both of which result from noise in the signal processing circuits generated by the detection of the scattered or secondary radiation rays.

Collimators are positioned to substantially absorb the undesired radiation before it reaches the detector. The collimator comprises a relatively high atomic number material placed so that undesired radiation strikes the body of the collimator and is absorbed before being able to strike the detector. In a typical detector system, the collimator includes barriers extending outwardly from the detector surface in the direction of the radiation source so as to form channels through which the radiation must pass in order to strike the detector surface.

Some radiation imaging systems, such as computerized tomography (CT) systems used in medical diagnostic work, use a point (i.e. a relatively small, such as 1 mm in diameter or smaller) source of x-ray radiation to expose the subject under examination. The radiation passes through the subject and strikes a radiation detector positioned on the side of the subject opposite the radiation source. In a CT system the radiation detector typically comprises a number of one-dimensional arrays of detector elements. Each array is disposed on a flat panel or module, and the flat panels are typically arranged end to end along a curved surface to form a radiation detector arm. The distance to a given position, typically the center of the panel, on any one of the separate panels is the same, i.e., each panel is at substantially the same radius from the radiation source. On any given panel there is a difference from one end of the panel to the other end in the angle of incidence of the radiation beams arriving from the point source. In any system using a "point source" of radiation and panels or modules of detector elements, some the radiation beams that are desired to be detected, i.e., those traveling directly from the radiation source to the detector surface, strike the detector surface at some angle offset from vertical.

For example, in a common medical CT device, the detector arm is made up of a number of panels or modules, each of which has dimensions of about 32 mm by 16 mm, positioned along a curved surface having a radius of about 1 meter from the radiation point source. Each panel has about 16 separate detector elements about 32 mm long by 1 mm wide arranged in a one-dimensional array, with collimator plates situated between adjoining elements and extending outwardly from the panel to a height above the surface of the panel of about 8 mm. As the conventional CT device uses only a one-dimensional array (i.e., the detector elements are aligned along only one axis), the collimator plates need only be placed along one axis, lengthwise between each adjoining detector element. Even in an arrangement with a panel of sixteen 1 mm-wide detector elements adjoining one another (making the panel about 16 mm across), if the collimator plates extend perpendicularly to the detector surface there can be significant "shadowing" of the detector element by the collimator plates towards the ends of the panel. This shadowing results from some of the beams of incident radiation arriving along a path such that they strike the collimator before reaching the detector surface. Even in small arrays as mentioned above (i.e. detector panels about 32 mm long), when the source is about 1 meter from the panel and the panel is positioned with respect to the point source so that a ray from the source strikes the middle of the panel at right angles, over 7.5% of the area at the end detector elements is shadowed by collimator plates that extend 8 mm vertically from the detector surface. Even shadowing of this extent can cause significant degradation in imager performance as it results in nonuniformity in the x-ray intensity and spectral distribution across the detector module. In a one-dimensional array, the collimator plates can be adjusted to be slightly offset from vertical to compensate for this variance in the angle of incidence of radiation from the point source.

Advanced CT technology requires use of two-dimensional arrays, i.e., arrays of detector elements on each panel that are typically arranged in rows and columns. In such an array, a collimator must separate each detector element along both axes of the array. The radiation rays from the point source to each detector on the array have different orientations, varying both in magnitude of the angle and direction of offset from the center of the array. Setting up collimator plates along two axes between each of the detector elements in two dimensional arrays would be extremely time consuming and difficult. Additionally, arrays larger than the one-dimensional array discussed above may be advantageously used in imaging applications. As the length of any one panel supporting detector elements increases, the problem of the collimator structure shadowing large areas of the detector surface becomes more important.

Accordingly, one object of the present invention is to provide a highly focused collimator for use in imagers having point radiation sources and an efficient method to readily fabricate such a collimator.

Another object is to provide a readily-fabricated collimator for use with two-dimensional detector arrays used in conjunction with a point radiation source.

SUMMARY OF THE INVENTION

In a radiation detection system in which the radiation desired to be detected is emitted from a single point source, a collimator is provided which comprises a plurality of relatively thin collimator plates stacked together to form a collimator body. Each collimator plate has a number of passages arranged corresponding to a selected pattern. The collimator plates are stacked together to form a collimator body and so that the passages, which extend between openings in opposite surfaces of each plate, form channels that extend through the collimator body. These channels allow radiation traveling along a direct path from the point source to pass through to underlying radiation detectors while substantially all other radiation beams striking the collimator are absorbed. The axis of each channel has a selected orientation angle so that it is substantially aligned with the direct beam path between the radiation point source and the underlying radiation detector element.

The collimator plate may comprise relatively thin sheets of radiation absorbent material, such as tungsten, or alternatively may comprise a patterned substrate, the surfaces of which are coated with a radiation absorbent material. The radiation absorbent material is selected to absorb radiation of the energy level and wavelength emitted by the radiation source and typically comprises a material having a relatively large atomic number (i.e., about 72 or larger). Such a collimator is advantageously used in an x-ray imager having a two-dimensional radiation detector array.

A method of forming a collimator is also provided, including the steps of selectively removing material from each of a plurality of collimator plates to form passages corresponding to a respective selected pattern for each of the plates, and stacking the plates together to form a collimator body, with the adjoining passages in the collimator plates forming channels through the collimator body. The axis of each channel is aligned along a respective orientation angle which corresponds to a direct path between the radiation source and a radiation detector element underlying the collimator channel. Photolithographic techniques may be used in forming passages in the collimator plates, and can include wet etching of thin sheets of radiation absorbent material or alternatively exposing and etching a photosensitive substrate material, and then coating the substrate with a layer of photosensitive material.

BRIEF DESCRIPTION OF THE DRAWINGS

The features of the invention believed to be novel are set forth with particularly in the appended claims. The invention itself, however, both as to organization and method of operation, together with further objects and advantages thereof, may best be understood by reference to the following description in conjunction with the accompanying drawings in which like characters represent like parts throughout the drawings, and in which:

FIG. 4(*b*) is a detailed cross-sectional view of one channel in the collimator body of FIG. 4(*a*) fabricated in accordance with one embodiment of the present invention.

DETAILED DESCRIPTION OF THE PREFERRED EMBODIMENT

Figure 1:
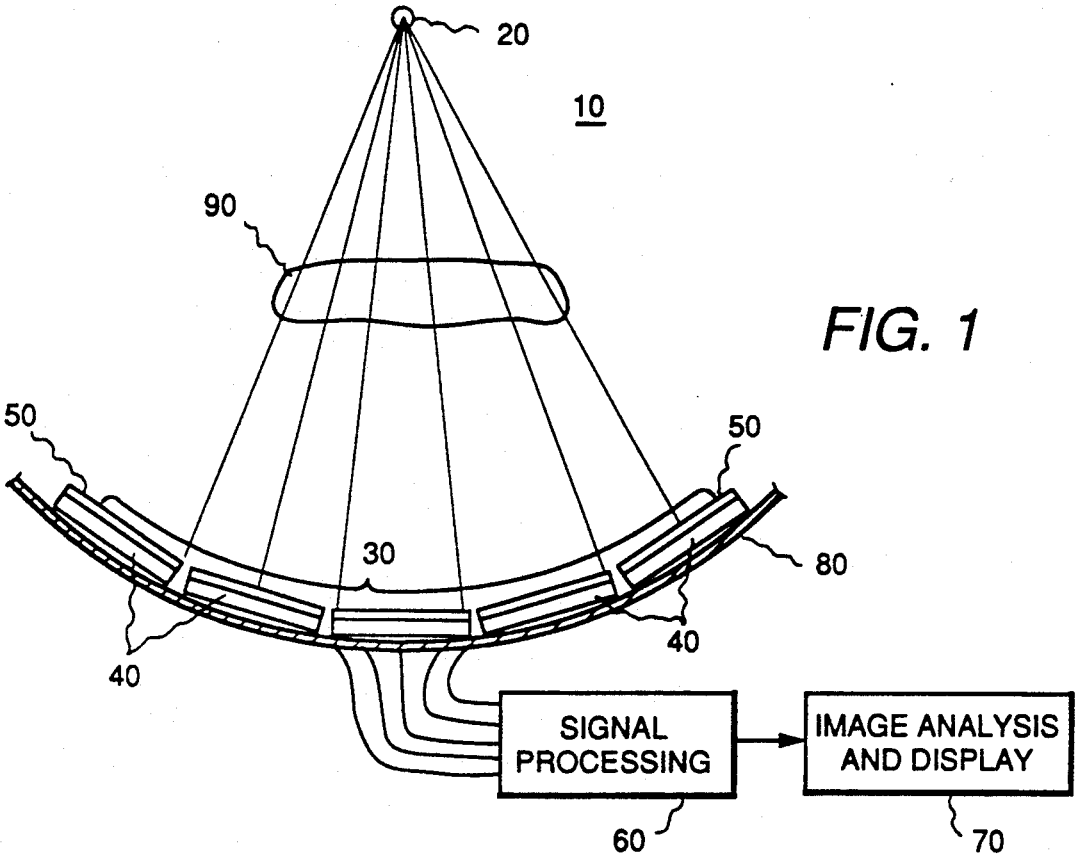
FIG. 1 is a schematic diagram of a CT radiation imaging system incorporating the collimator of the present invention.

A radiation imager system 10, such as a medical computed tomography (CT) system incorporating the device of the present invention, is shown in schematic form in FIG. 1. CT system 10 comprises a radiation point source 20, typically an x-ray source, and a radiation detector 30 comprising a plurality of radiation detector modules or panels 40 and a plurality of collimators 50 disposed between radiation source 20 and detector panels 40. Each detector panel comprises a plurality of detector elements (not shown) which produce an electrical signal in response to the incident radiation. The detector elements are typically arranged in a one- or two-dimensional array on each detector plate 40. The radiation detector elements are coupled to a signal processing circuit 60 and thence to an image analysis and display circuit 70. Detector plates 40 are mounted on a curved supporting surface 80 which is positioned at a substantially constant radius from radiation point source 20.

This arrangement allows a subject 90 to be placed at a position between the radiation source and and the radiation detector for examination. Collimators 50 are positioned over radiation detector panels 40 to allow passage of radiation beams that emanate directly from radiation source 20, through exam subject 90, to radiation detector panels 40, while absorbing substantially all other beams of radiation that strike the collimator. The details of steps in the fabrication, and the resulting structure, of collimators 50 are set out below.

Figure 2:
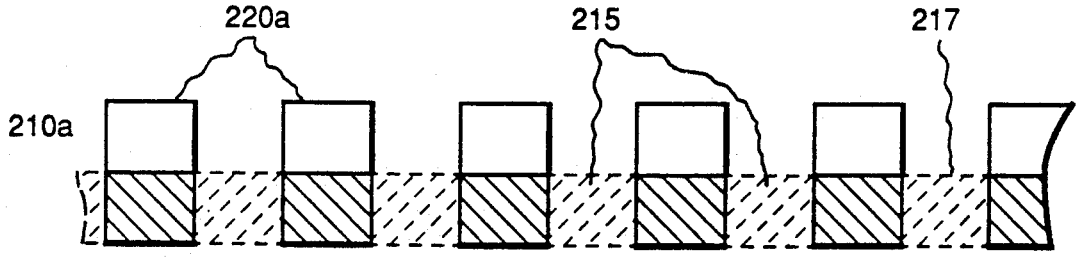
FIGS. 2(*a*) and 2(*b*) are cross-sectional views of collimator plates for the present invention during one step of the fabrication process in accordance with one embodiment of the invention.
Figure 2:
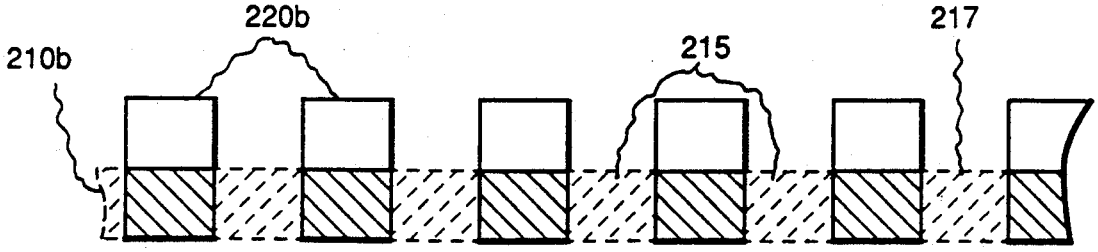

In accordance with this invention, material is selectively removed from each of a plurality of collimator plates to form a plurality of passages in each plate. Two representative plates, 210*a* and 210*b*, are illustrated in FIGS. 2(*a*) and 2(*b*) respectively. Passages 215 extend between openings in opposite surfaces of each plate. Preferably the shape of the sidewalls (e.g., vertical or slanted) in each individual plate is substantially the same, and each plate has sidewalls shaped similarly to those in adjoining plates. In one embodiment of this invention, the collimator plates comprise relatively thin (i.e., having a thickness less than about 0.25 mm) sheets of radiation absorbent material. The radiation absorbent material is selected to exhibit good absorption characteristics for radiation having the wavelength distribution emitted by radiation source 20, and typically comprises a material having a relatively high atomic number, i.e. about 72 or greater. Examples of such material include tungsten, gold, and lead.

Conventional photolithographic techniques are advantageously used to selectively remove material from collimator plates 210 to shape passages 215. For example, a mask 220*a* is formed on collimator plate 210*a* and a mask 220*b* is formed on collimator plate 210*b*, each mask having a selected pattern chosen to result in the formation of passages in the respective plates so that when the plates are assembled or stacked together the adjoining passages in the plates will form channels through the assembled collimator with respective axes having a respective selected orientation. If the photoresist used in the photolithographic processes does not adhere well to the radiation absorptive material, a transfer mask may be used in order to form a mask of a material that does adhere well to the material to be etched. The pattern of the mask is selected for each collimator plate and typically results in the passages being positioned in slightly different places on each respective plate. The desired positions of the passages on the plate are dependent on the location of the plate with respect to the underlying radiation detector elements in the assembled collimator device, the arrangement of detector elements in the detector array, and the path along which radiation emanating from the radiation point source passes to the detector element. After the mask is formed, the collimator plates are etched to form a plurality of passages 215 (portions of the collimator plates that are removed in the etching process are shown in dotted cross hatching in FIGS. 2(*a*) and 2(*b*)). Known etching processes are used to form the passages, such as wet etching of tungsten. Alternatively, masks can be formed on both sides of the collimator plate and the plate then etched simultaneously from both sides.

To assist with alignment of the collimator plates, an alignment hole 217 may advantageously be formed in each collimator plate at the time passages 215 are formed. One or more alignment holes are positioned in the same respective positions on each collimator plate to be used as a reference point so that the plates can be properly positioned with respect to one another when they are stacked together to form the collimator.

Figure 3:
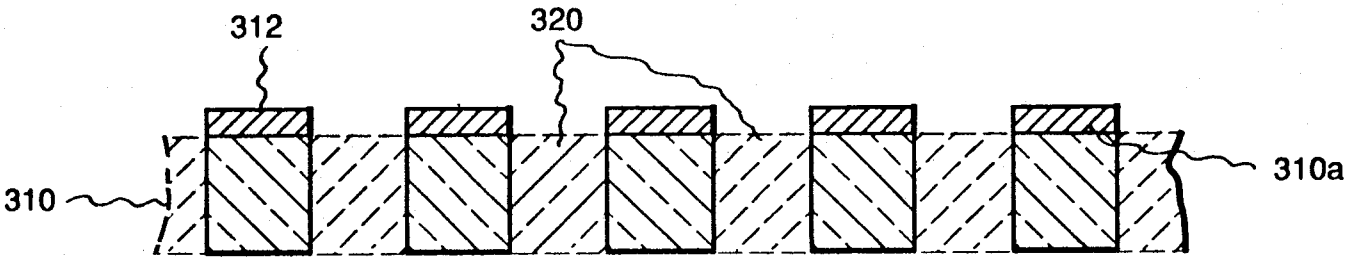
FIGS. 3(*a*) and 3(*b*) are cross-sectional view of the formation of a collimator plate in accordance with another embodiment of the present invention.
Figure 3:
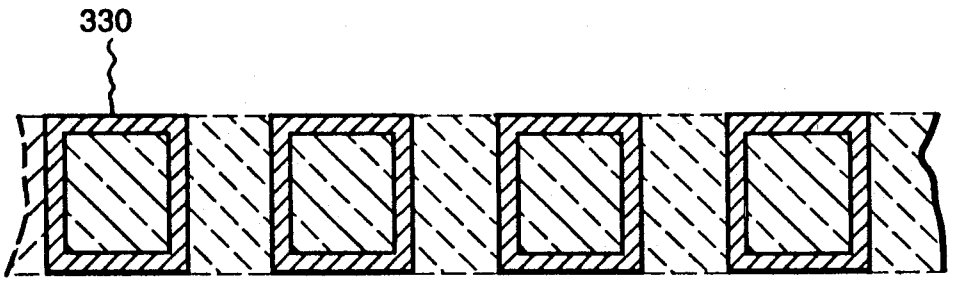

In an alternative embodiment of the present invention, collimator plates comprise collimator substrates 310 coated with radiation absorbent material 330, as illustrated in FIGS. 3(*a*) and 3(*b*) respectively. Substrate 310 comprises photosensitive material, i.e., a material that will react to exposure to light in a manner similar to photoresist. Such a material may lose its photosensitive characteristics once it has been exposed and processed. One example of this type of substrate material is the Corning, Inc. product known as Fotoform® glass. Collimator substrate 310 is selectively exposed through a mask to a light source so that the light exposes areas of the photosensitive substrate corresponding to a selected pattern for each collimator plate. For example, an optically opaque mask 312 is formed by conventional methods on a first surface 310*a* of collimator substrate 310. The pattern of openings in mask 312 corresponds to the pattern of detector elements in radiation detector panel 40 (FIG. 1). For example, mask 312 has a pattern mimicking the arrangement, i.e., rows and columns, and the cross-sectional shape of detector elements at the interface between radiation detector panel 40 and collimator 50 (FIG. 1). Alternatively, mask 312 need not be on the surface of the collimator substrate but can be positioned with respect to the substrate in accordance with known photolithographic techniques to provide the desired exposure of the photosensitive material in substrate 310. In any event, the pattern of the mask is selected to expose areas of photosensitive collimator substrate 310 of sufficient size and orientation so that upon completion of fabrication of collimator 50, the surface of each radiation detector element for receiving the radiation is exposed to radiation passing along the desired paths from the radiation source.

Collimator substrate 310 is then etched using conventional techniques appropriate for the substrate photosensitive material to remove the exposed photosensitive material and thus create a plurality of passages 320 through the substrate, as illustrated in FIG. 3(*a*). Portions of the photosensitive material that are removed in the etching are shown in dotted cross hatching in the figure. Each of these passages extends between openings in opposite surfaces of the collimator plate. Preferably the sidewalls of the passages on each individual plate have substantially the same shape and orientation, and are of substantially the same shape and orientation as the passage sidewalls in other plates used in the assembled imager system.

A radiation absorbent material layer 330 (FIG. 3(*b*)) is then applied on collimator substrate 310 so as to cover at least the surfaces of the substrate which will be exposed to radiation when assembled in an imager device. The radiation absorbent material applied on the far interior wall of the channel is shown in dotted cross hatching. For example, many types of radiation absorbent material can be applied through known vapor deposition techniques. Radiation absorbent material 330 is selected to absorb radiation of the energy level and wavelength emitted by radiation source 20 (FIG. 1). The radiation absorbent material typically has a relatively high atomic number, e.g., greater than about 72, and advantageously comprises tungsten, gold or lead when the radiation used in the imager device is x-ray. The thickness of the radiation absorbent material layer is selected to provide, when the collimator is assembled, efficient absorption of radiation. This selected thickness depends on the nature of the radiation and the energy level of the radiation when it strikes the collimator. For example, in a CT system using an x-ray point radiation source of about 100 KeV positioned approximately one meter from the detector array, the collimator plates would need to present a collective tungsten thickness in a range of between about 30 to 40 mils along the path of the radiation to be absorbed. After application of the radiation absorbent material, the cross-sectional area of the opening or the void space in the passage is substantially the same as the area for receiving radiation on the detector element which it adjoins so as to allow substantially all radiation rays emanating along direct paths from the radiation source to strike the detector element.

Figure 4:
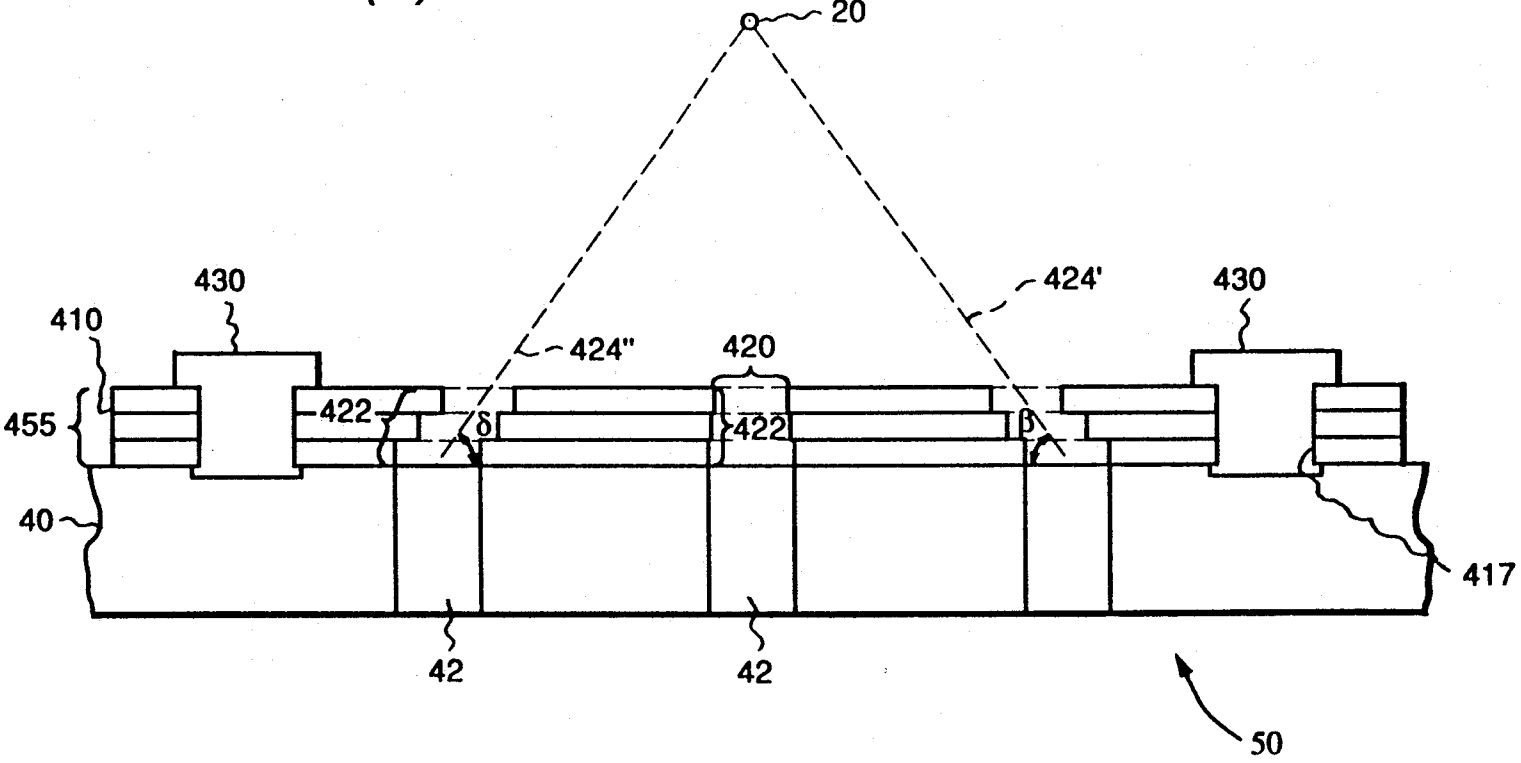
FIG. 4(*a*) is a cross-sectional view of a radiation imaging device having a collimator fabricated in accordance with one embodiment of the present invention.
Figure 4:
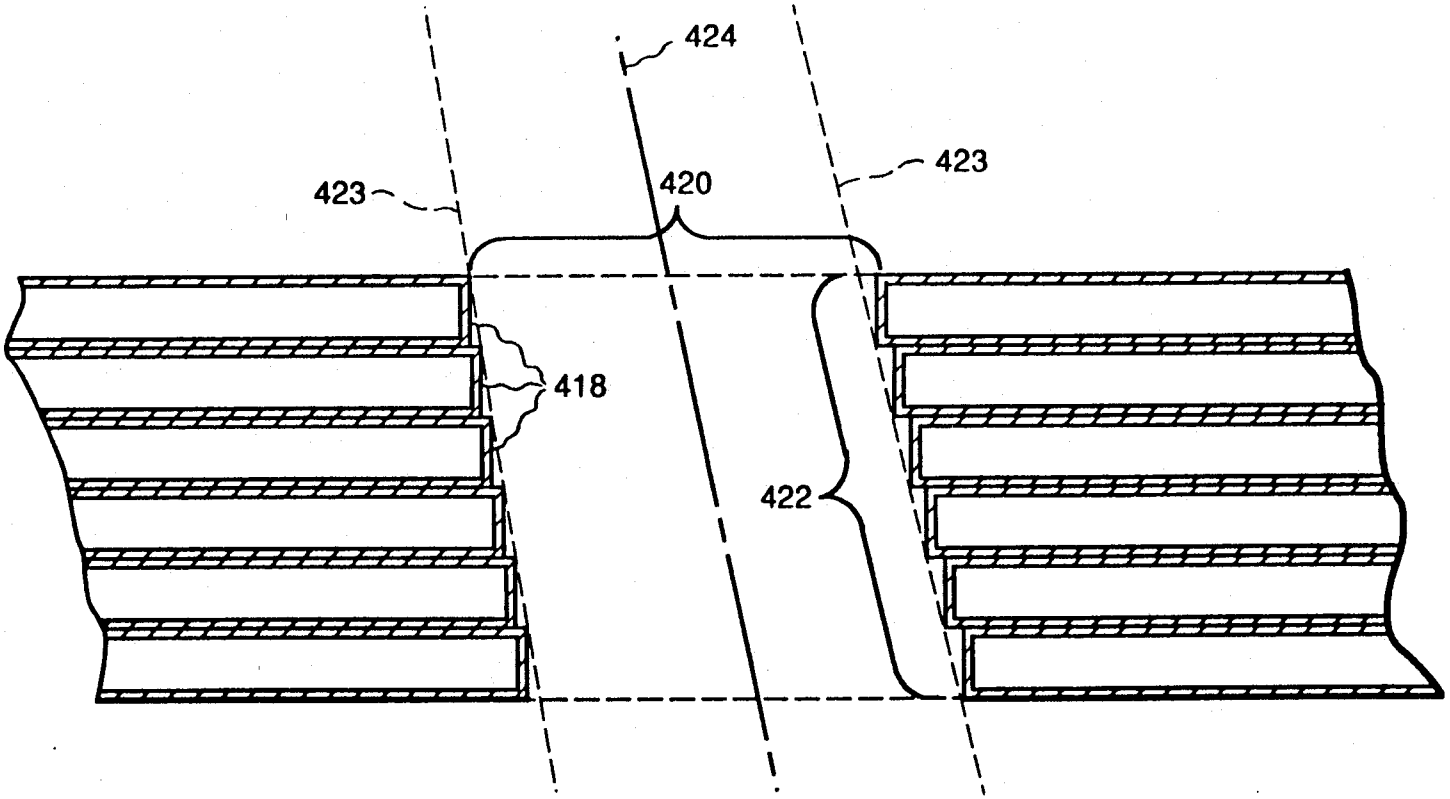

The collimator plates are then stacked, i.e., assembled one over the other as shown in FIG. 4(*a*), to form a collimator body 455 and aligned so that respective passages in the collimator plates form a plurality of respective channels 420 through the collimator body. The collimator plates are advantageously aligned in the stacking process by positioning an alignment hole 417 about an alignment rod 430. Alternatively, optical alignment devices aimed through alignment holes 417 or alignment of the edges of the plates can be used to provide correct alignment of the passages when stacking the collimator plates.

In the assembled collimator 50 of FIG. 1, shown in a detailed view in FIG. 4(*a*), each collimator plate 410 comprises a patterned sheet of radiation absorbent material or alternatively comprises a photosensitive material substrate coated with a radiation absorbent material. Each channel is defined by sidewalls 418 of the respective passages in each collimator plate. The sidewalls of each respective passage in adjoining collimator plates form a step-shaped boundary 422 of channel 420 in collimator body 455. As illustrated in FIG. 4(*b*), a longitudinal axis 424 of each channel is substantially equidistant from a pair of longitudinal tangent lines 423 passing along the portions of sidewalls 418 which extend furthermost into the channel. The orientation of the tangent lines towards a convergence point above the collimator (i.e., the radiation point source) is exaggerated for illustration purposes. The longitudinal axis for each channel will have a unique selected orientation angle, varying in magnitude and orientation (i.e., displacement in an x or y direction, or a combination of those directions, in the plane of the radiation detector array). For example, in the plane of the cross-sectional view presented in FIG. 4(*a*), axis 424' has a selected orientation angle $\beta$ and axis 424'' has a selected orientation angle $\partial$, each of which are in the plane of the drawing but which differ in magnitude and in direction of displacement with respect to the radiation source. With a two-dimensional array of radiation detectors 42, the various selected orientation angles would also be displaced in a plane normal to the plane of the cross-sectional illustration of FIG. 4(*a*). The magnitudes of the selected orientation angles typically range between about 0° and 10°.

In accordance with the present invention, each longitudinal axis of each respective channel in the collimator body is aligned with a respective selected orientation angle, which angle corresponds to the direct path between radiation point source 20 and radiation detector element 42 adjoining the channel (FIG. 4(*a*)). The radiation beams spread out from the point source so as to strike each radiation detector element disposed on a planar array at a slightly different angles respectively, the magnitude and orientation of which depend on the position of the detector in the array. The pattern of the passages in each collimator plate is selected so that when the plates are stacked together each of the channels formed has an axis oriented along a selected orientation angle that corresponds with the path of a radiation beam from the point source to the radiation detector in the assembled imager.

The number of collimator plates used in the assembly of the collimator body is dependent on the energy level and wavelength of the radiation to be collimated and hence the overall thickness of radiation absorptive material necessary to absorb radiation striking the collimator.

As illustrated in FIG. 4(*a*), in the assembled device, collimator body 455 is disposed to adjoin radiation detector panel 40. Radiation detector elements 42 are positioned in an array on detector panel 40 and each typically comprises a scintillator coupled to a photodetector. Collimator body 455 is positioned to allow incident radiation on a direct path between the radiation source and each one of the radiation detector elements 42 to pass through the channels in the collimator. Beams of radiation that are not aligned with such a direct path strike the collimator body and are absorbed.

Figure 5:
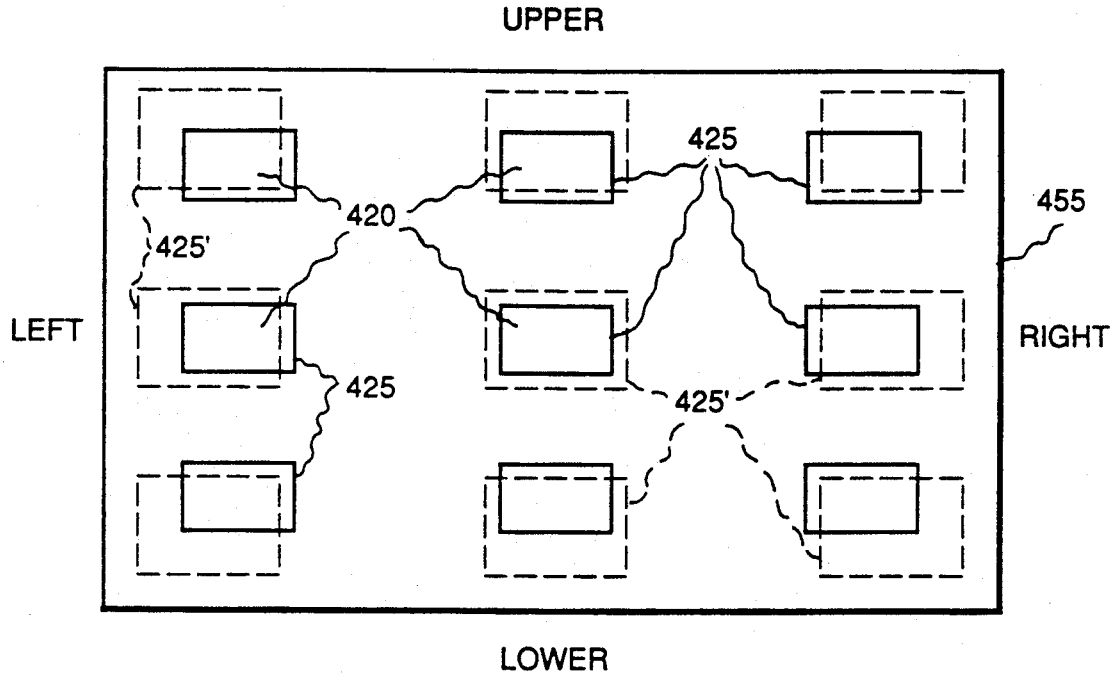
FIG. 5 is a plan view of a collimator fabricated in accordance with the present invention for use with a two-dimensional detector array.

The collimator of the present invention is readily used with either a one-dimensional or a two-dimensional array of radiation detector elements. A plan view of a collimator fabricated in accordance with the present invention and showing a representative number of channels 420 appears in FIG. 5. The figure has been marked to show left, right, upper, and lower edges solely to provide a reference for ease of discussion, and the selection and positioning of such references is not meant to constitute any limitation on the structure or positioning of the device of the invention. Channel openings 425 in the surface of the collimator closest to the radiation source are shown in dark outline and channel openings 425' on the opposite surface of collimator body 455 are shown in phantom. In the two-dimensional array the center channel is in substantial vertical alignment with the radiation source, and the opening 425' of the channel on the side of the collimator body opposite the radiation source is aligned with the opening in the surface closest to the radiation source. As the radiation beams spread out as they emanate from the point source, each of the openings 425' has a slightly larger cross-sectional area than its respective opening 425 in the surface of the collimator closest to the radiation source. Openings 425' for channels on the left, right, top, or bottom are also slightly offset from being in vertical alignment with their respective openings 425. The direct path from the radiation source to a radiation detector in the upper left hand corner, for example, is offset both to the left and to the upper side of the array. The selected orientation angle of the axis of the channel is substantially aligned with this direct path, and the channel thus extends through the collimator body at this angle. The selected orientation angle for each channel is different from any other channel in the collimator. Such a structure, which would be extremely difficult and time consuming to construct with conventional collimator fabrication techniques, is readily produced in accordance with this invention.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A collimator for collimating radiation beams having a predetermined wavelength distribution emitted from a radiation point source comprising:

a plurality of collimator plates stacked together immediately adjacent to one another to form a collimator body, said collimator body being adapted to be situated adjacent to an array of radiation detector elements and having a first surface disposed closest to said array of radiation detector elements;

each of said collimator plates comprising radiation absorbent material and having passages therein corresponding to a selected pattern;

said plurality of collimator plates being situated so that each of said passages in conjunction with respective passages in adjoining collimator plates form a plurality of respective channels disposed through said collimator body, each of said channels extending from one of said passages opening on said first surface to a respective one of said passages opening on said second surface and having contiguous sidewalls comprising said radiation absorbent material disposed along its length, the passages of each of said channels opening on said second surface being in substantial alignment with a respective one of said detector elements, the longitudinal axis of each of said channels having a selected orientation angle substantially aligned with a direct beam path between said point source and the respective detector element adjoining said channel.

2. The collimator of claim 1 wherein each of said passages has substantially similarly-shaped sidewalls.

3. The collimator of claim 1 wherein said radiation absorbent material is selected to substantially absorb radiation of the wavelength distribution emitted by said radiation point source.

4. The collimator of claim 3 wherein said radiation absorbent material comprises one of the group consisting of tungsten, gold, and lead.

5. The collimator of claim 3 wherein each of said collimator plates comprises a sheet of said radiation absorbent material.

6. The collimator of claim 3 wherein said collimator plates each comprise a photosensitive material substrate overlaid with said radiation absorbent material.

7. The collimator of claim 1 wherein the cross-sectional shape of each of said channels corresponds to the cross-sectional shape of said detector element respectively aligned therewith.

8. The collimator of claim 1 wherein said selected pattern of passages in said collimator plates corresponds to the arrangement of said radiation detector elements in said detector array.

9. The collimator of claim 8 wherein said detector elements are arranged in a two-dimensional array.

10. The collimator of claim 1 wherein the respective selected orientation angles of said channels range between about 0° and 10°.

11. A radiation imaging device comprising:

a radiation point source;

a radiation detector comprising an array of detector elements, said array being disposed to detect radiation emitted from said point source; and a collimator disposed between said detector element array and said radiation point source, said collimator comprising a plurality of collimator plates stacked immediately adjacent to one another, each of which has a selected pattern of passages therein, said plurality of collimator plates being joined together so that each of said passages in conjunction with respective passages in an adjoining collimator plate form a plurality of channels through said collimator to pass radiation emitted by said point source to respective ones of said detector elements, each of said channels having contiguous sidewalls comprising said radiation absorbent material disposed along its length and further having respective longitudinal axes aligned along respective selected orientation angles, said orientation angles corresponding to respective direct paths from said point sour e to respective ones of said detector elements.

12. The device of claim 11 wherein said radiation point source comprises an x-ray source.

13. The device of claim 12 wherein said collimator plates are comprised of an x-ray absorbent material.

14. The device of claim 13 wherein said radiation absorbent material comprises a material chosen from the group consisting of tungsten, gold and lead.

15. The device of claim 13 wherein each of said collimator plates comprises a photosensitive glass substrate overlaid with said radiation absorbent material.

16. The device of claim 13 wherein each of said collimator plates comprises a sheet of said radiation absorbent material.

17. The device of claim 11 wherein the respective selected orientation angles of said channels range between about 0° and 10°.

18. The device of claim 11 wherein said detector elements are arranged in a two-dimensional array.

* * * * *